US007246469B2

(12) United States Patent
Back et al.

(10) Patent No.: US 7,246,469 B2
(45) Date of Patent: Jul. 24, 2007

(54) MULTI-PIECE EAVES BEAM FOR PREASSEMBLED GLAZED ROOF SYSTEM

(75) Inventors: Mark A. Back, Surfside Beach, SC (US); J. Michael Riley, Swinton (GB); John E. Welsh, Hamilton, OH (US)

(73) Assignee: Park Lane Conservatories Ltd., Poynton, Cheshire (GB)

( * ) Notice: Subject to any disclaimer, the term of this patent is extended or adjusted under 35 U.S.C. 154(b) by 366 days.

(21) Appl. No.: 10/319,933

(22) Filed: Dec. 16, 2002

(65) Prior Publication Data

US 2004/0111985 A1 Jun. 17, 2004

(51) Int. Cl.
*E04B 7/04* (2006.01)
*E04D 13/03* (2006.01)

(52) U.S. Cl. ..... 52/90.1; 52/92.1; 52/94; 52/82; 52/650.1; 52/640

(58) Field of Classification Search ..... 52/DIG. 17, 52/90.1–90.2, 92.1–92.3, 93.1, 93.2, 460–461, 52/465, 469, 506.07, 720.1, 729.1, 734.2, 52/733.1, 733.2, 733.4, 582.1, 270–272, 52/72–78, 94–95, 79.1, 79.12, 82, 650.1, 52/731.3, 640

See application file for complete search history.

(56) References Cited

U.S. PATENT DOCUMENTS 3,150,463 A * 9/1964 Nearing et al. ..... 52/92.2
4,057,941 A 11/1977 Schwartz
4,114,330 A * 9/1978 Sukolics ..... 52/200
4,261,143 A 4/1981 Rizzo
4,296,576 A * 10/1981 Rice et al. ..... 52/92.2
4,433,514 A * 2/1984 Henges et al. ..... 52/94
4,872,297 A 10/1989 Hetzel et al. ..... 52/92
4,878,330 A * 11/1989 Machin ..... 52/781
5,144,776 A * 9/1992 Hetzel et al. ..... 52/92.2

(Continued)

FOREIGN PATENT DOCUMENTS

FR 2757891 A 7/1988

(Continued)

OTHER PUBLICATIONS

Aluminum Profiles and Accessories Ltd., *Conservatory and Roofing System Handbook* (1991).

(Continued)

*Primary Examiner*—Winnie Yip
(74) *Attorney, Agent, or Firm*—Wood Herron & Evans LLP

(57) ABSTRACT

An eaves beam for a glazed roof system includes a base member and an upper member. The base member includes a base plate adapted to rest on a building wall and includes upstanding wall members. The base member can be fastened from the top into the wall with the fastener extended between the two upstanding wall members. In turn, the upper portion of the eaves beam includes downwardly extended legs which are adapted to fit over the base member and are fastened to the base member by screws extended laterally through the legs into the base member. This facilitates installation of the eaves beam and allows the roof to be pre-assembled, taken to the work site and installed.

20 Claims, 5 Drawing Sheets

U.S. PATENT DOCUMENTS

| | | | | |
|---|---|---|---|---|
| 5,209,031 | A * | 5/1993 | Tavano | 52/92.2 |
| 5,826,380 | A * | 10/1998 | Wolfe | 52/90.1 |
| 5,836,117 | A * | 11/1998 | Johnson | 52/201 |
| 5,927,027 | A * | 7/1999 | Richardson | 52/200 |
| 6,223,481 | B1 * | 5/2001 | Rickman | 52/90.1 |
| 6,631,594 | B2 * | 10/2003 | Whiting | 52/204.69 |

FOREIGN PATENT DOCUMENTS

| | | | |
|---|---|---|---|
| GB | 2204627 | A | 11/1988 |
| GB | 2256880 | | 12/1992 |
| GB | 2256880 | A | 12/1992 |
| GB | 2287493 | | 9/1995 |
| GB | 2287493 | A | 9/1995 |
| GB | 2347945 | A | 9/2000 |
| GB | 2376961 | A | 5/2001 |
| WO | WO 02/097213 | A1 | 12/2002 |

OTHER PUBLICATIONS

Conservatory and Roofing System Handbook, *The APA Conservatory System*, Aluminum Profiles and Accessories Ltd., Copyright APA 1999.

* cited by examiner

MULTI-PIECE EAVES BEAM FOR PREASSEMBLED GLAZED ROOF SYSTEM

BACKGROUND

Typically roofs are assembled on site. Walls are assembled and the rafters and other structure are assembled to form a complete roof. This is also true for glazed roof systems.

Glazed roof systems are used to form various types of roofs. These can include Georgian-style, conservatory-style and lean-to roofs. Glazed roof systems include panels supported between adjacent rafters. The rafters are supported at their upper end by a variety of structures such as a hip beam, a ridge beam, a wall plate or the like. At the opposite end, the rafters are supported by an eaves beam. This is a metal beam that has a structure adapted to support the rafter and form a seal at the lower end of the panels. The glazing is designed to prevent air and water ingress.

These units are all typically constructed on site because the eaves beam must be attached to the wall header prior to the rafters. The rafters in turn are fastened to the eaves beam with the glazing panel fastened to the rafters and hip beam. This on site construction is problematic simply because it is very labor intensive requiring a great deal of time to ensure that everything is properly installed to prevent leakage. Even with relatively small roofs, such as bay window roofs, on site fabrication is required.

SUMMARY OF THE INVENTION

It is an object of the present invention to provide a construction method which facilitates assembly of a roof structure prior to attaching it to a wall structure. It is an object of the present invention to provide an eaves beam which is easier to install and allows for pre-assembly of a roof prior to being attached to a wall structure.

Further, it is an object of the present invention to provide such an eaves beam which can be installed by inserting fasteners from the top of the supporting wall as opposed from underneath the supporting walls.

Further, it is an object of the present invention to provide an eaves beam which is more suited for a wide range of supporting walls, i.e., wood, masonry and the like.

The objects and advantages of the present invention are provided by a multi-piece eaves beam. The first lower portion is adapted to rest on a supporting wall and permits a screw to be inserted from the top of the first member through the first member into the wall structure holding it in position. An upper section of the eaves beam is then placed on the lower section and mates with the lower member. The upper member of the eaves beam is then screwed to the lower member through the side walls. This drastically improves installation efficiency.

With this construction, the roof can be pre-assembled at the factory with the hip beam or the like, rafters and upper section of the eaves beam all pre-assembled with the glazing panels attached and sealed. The preassembled roof is lowered down onto the lower section of the eaves beam which are attached to the header of a wall. This provides the efficiency of factory assembly while at the same time allows for sizing for a particular job. Because these roof sections are so light, a 10'×12' section can be easily placed on a roof by two or three individuals without the use of cranes or the like. Further, this is well suited for the prefabricated roofs to cover bay windows.

The upper member of the eaves beam can have an upper trough member which collects moisture and channels that water to the exterior of the building thus reducing accumulation of moisture inside the walls of the structure. Further, this structure is much more versatile than a one piece system. If a particular type of wall such as a masonry wall requires modification of the eaves beam, only the lower section needs to be changed and the upper section will remain the same. Further, the eaves beam can be formed from more than two sections if desired.

The objects and advantages of the present invention will be further appreciated in light of the following detailed drawings and descriptions in which:

DETAILED DESCRIPTION

Figure 1:
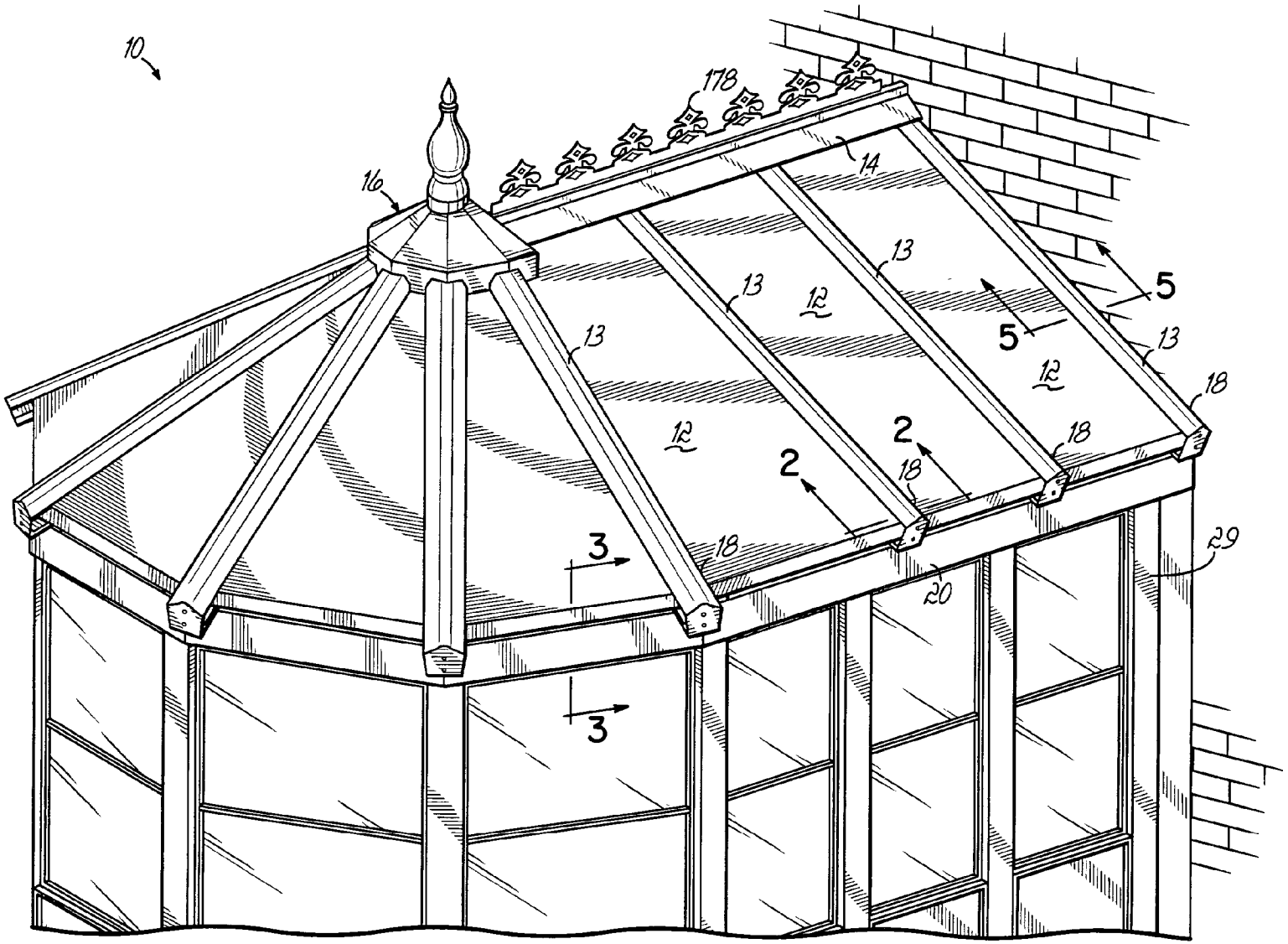
FIG. 1 is a plan view of the roof according to the present invention.

As shown in FIG. 1, the present invention provides for a glazed roof system 10 which incorporates a series of panels 12 supported by rafters 13. The drawing is exemplary showing a conservatory-style roof in which the rafters are supported at an upper end by a wall plate or bracket (not shown), a ridge beam 14 or a central support 16 also referred to as a spider. As indicated, this invention is suitable for any glazed roof system including conservatory roofs, lean to roofs and roofs for bay windows. The lower ends 18 of rafters 13 are in turn supported on an eaves beam 20. The panels can be glass, plastic or foil covered foam panels.

Figure 2:
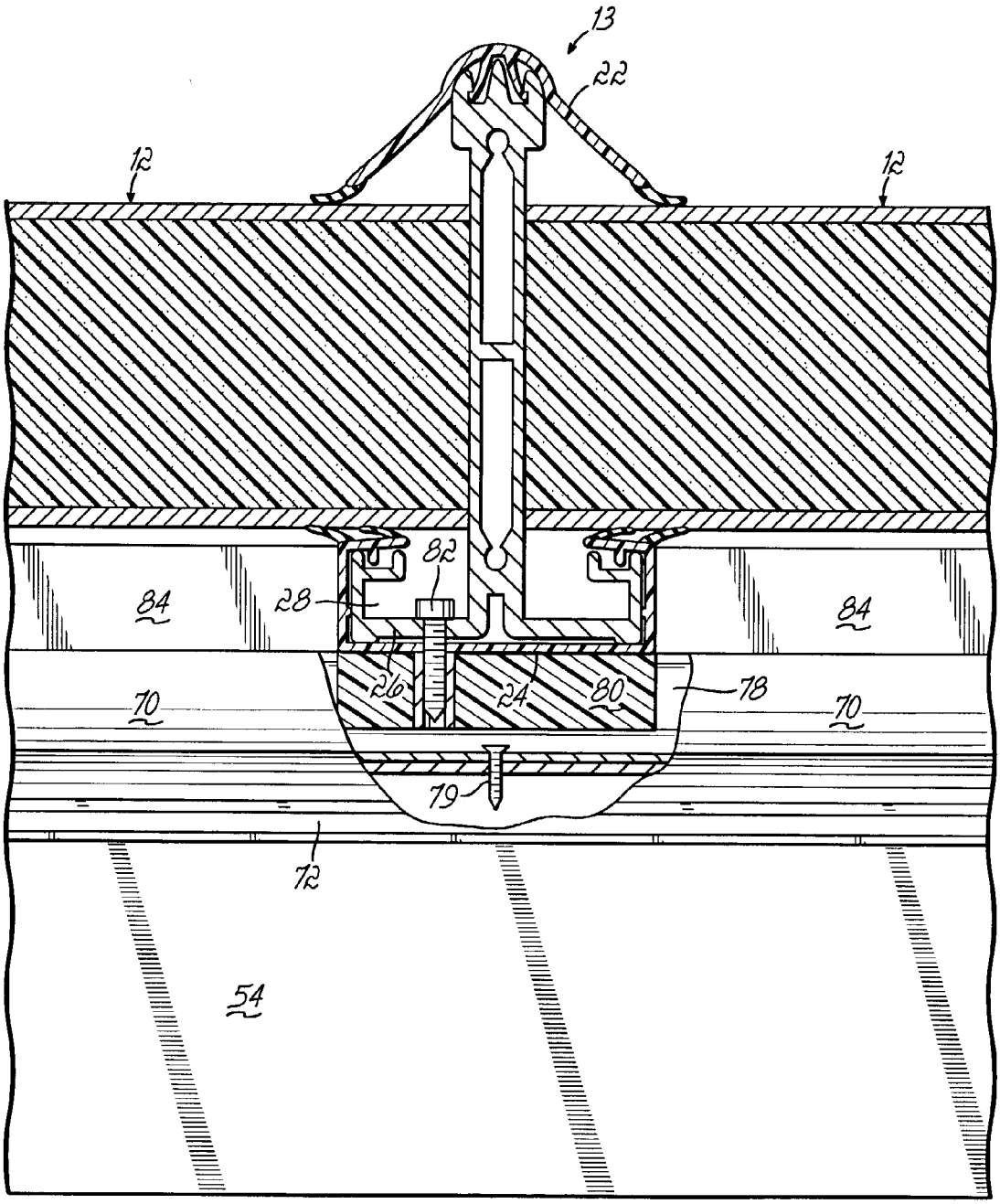
FIG. 2 is a cross-sectional view taken at lines 2—2 of FIG. 1.

As shown in FIG. 2, a seal is formed between the panels 12 and the rafters 13 by an upper sealing cap 22 and a lower sealing cap 24 which are both attached to a central metal rafter member 26. The sealing caps are designed to prevent ingress of water or air and further any water that does pass through the seal is directed through the channels 28 in the rafter members 26 downwardly to the exterior of the room.

Figure 3:
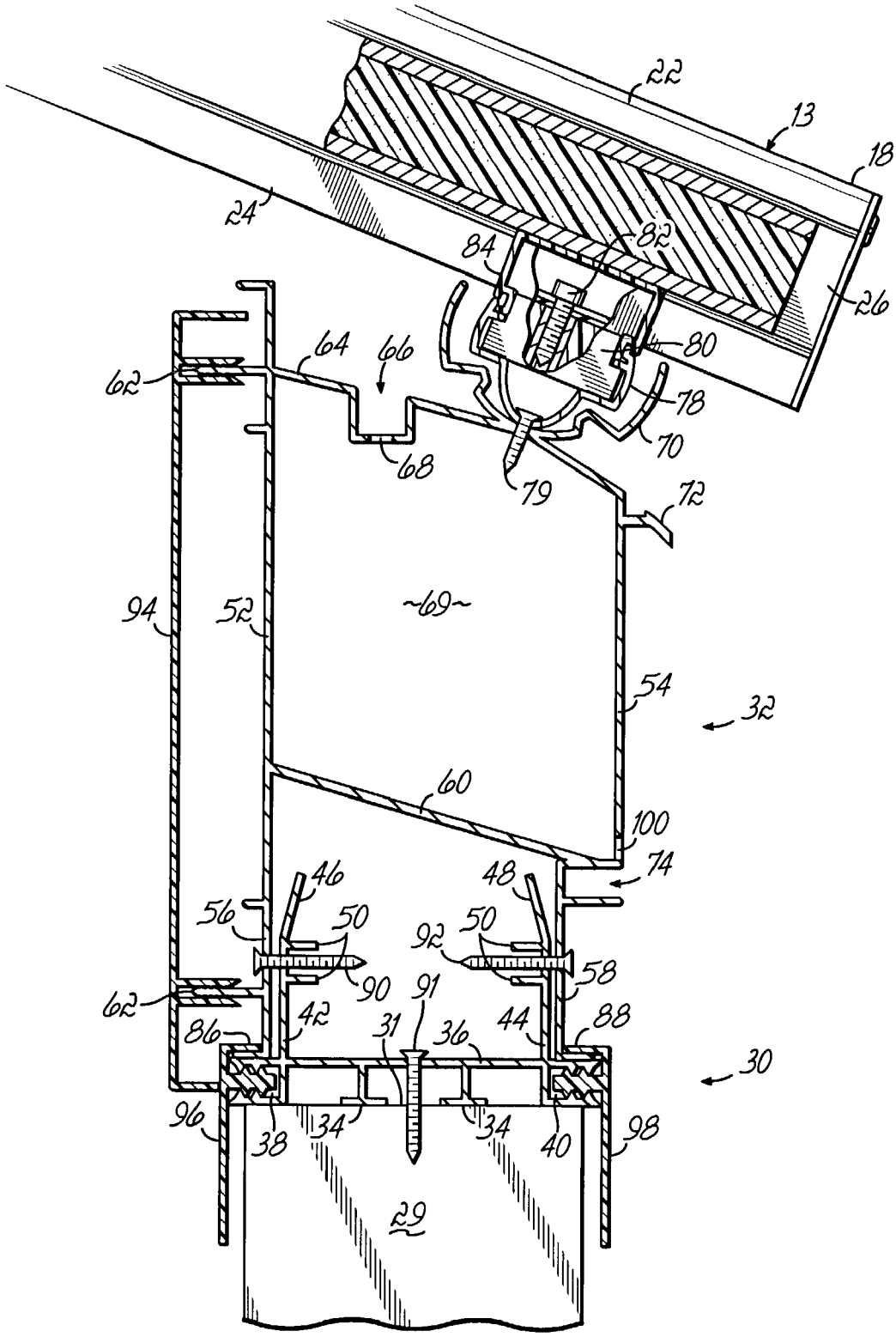
FIG. 3 is a cross-sectional view of the eaves beam of the present invention.
Figure 4:
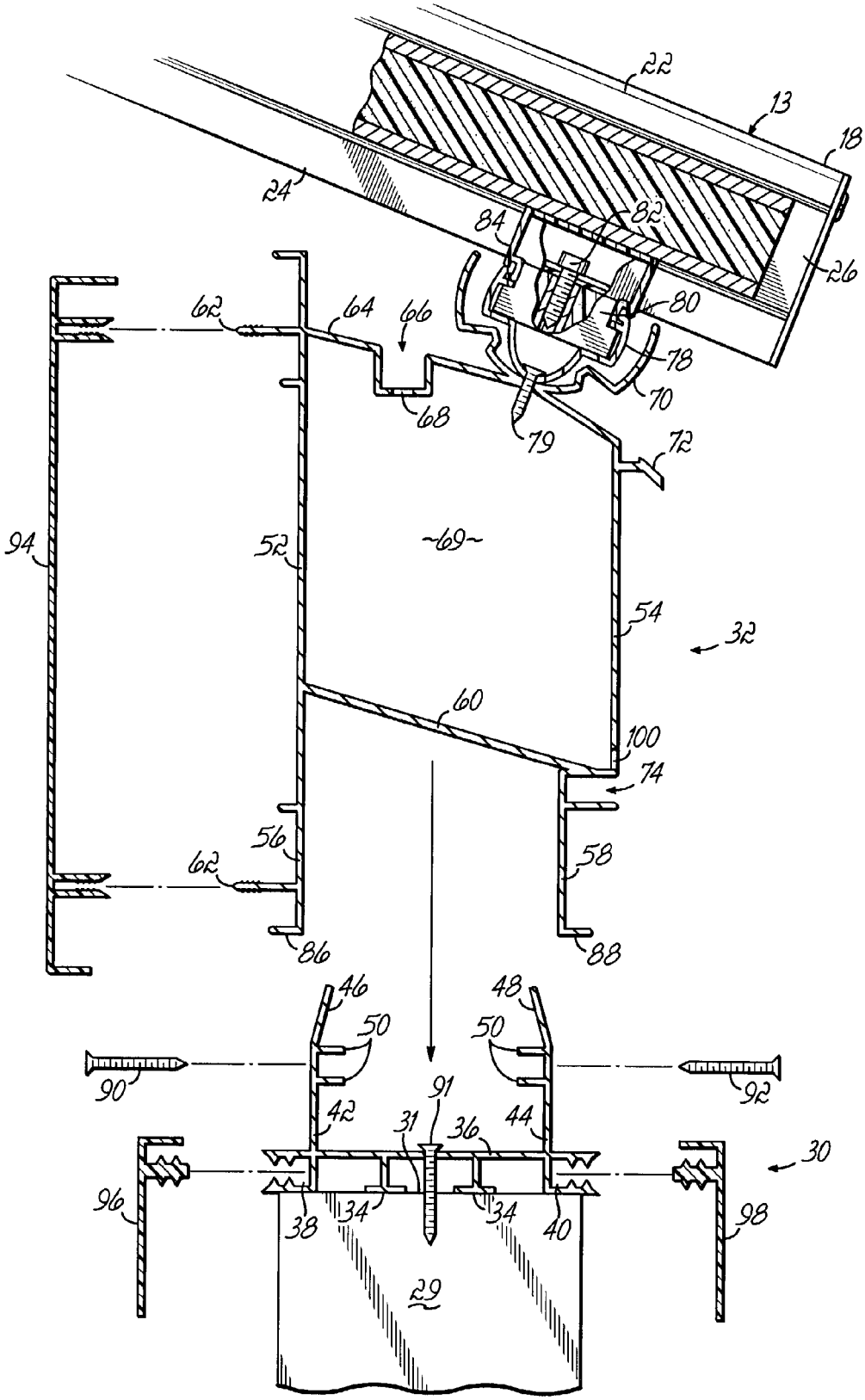
FIG. 4 is an exploded view of FIG. 3.

The eaves beams in turn are supported by a wall structure 29. The wall structure 29 is exemplary and can be a variety of different wall structures including a masonry structure, two by four wood structure, metal structure, or the like. As shown in FIGS. 3 and 4, the eaves beam is a two-piece construction which includes a base member 30 and upper member 32. The base member 30 as shown is designed to rest on a wall structure.

This base member 30 includes a plurality of feet 34 extended from base plate 36. It also includes grooves 38 and 40 which are designed to accept trim members 96 and 98. Extended up from the base plate 36 are inner and outer side walls 42 and 44. Upper portions 46 and 48 of side walls 42 and 44 are bent inwardly towards each other. The base walls also include a plurality of stiffening ridges 50.

The top member 32 includes an inner wall 52 and an outer wall 54. The walls 52 and 54 include lower leg members 56 and 58 which rest on base plate 36 and are spaced slightly outwardly from the walls 42 and 44 respectively of base member 30. The top portion further includes a downwardly sloping wall 60 which extends from inner wall 52 to outer wall 54. Inner wall 52 includes a plurality of barbed members 62 which are adapted to accept plastic trim 94.

The upper surface 64 of top member 32 includes a trough 66 which has a plurality of holes 68 which lead into the central hollow portion 69 of top member 32. Top wall 64 further includes a rafter support channel 70 which has a general C-shaped configuration. Outer wall 54 includes an upper ledge 72 and a lower channel 74 which are adapted to support either trim or a gutter system (neither of which is shown) if they are desired for the particular application.

The rafter supporting channel 70 supports a pivoting rafter support 78 which allows for angle adjustment or variation for the roof system. A fastener 79 extends through support 78 into channel 70 to establish the desired angle. Alternatively, a fixed angle system can be used. The support 78 further includes a plastic central member 80 which as shown in FIG. 3 is adapted to support the rafters with the lower sealing cap supported on the plastic member 80. A fastener 82 extends through rafter 13 into member 80. As shown, member 80 includes an internally threaded bushing which receives fastener 82. Running between rafters is a sealing channel 84 which provides a seal at the lower surface of panels 12.

Figure 5:
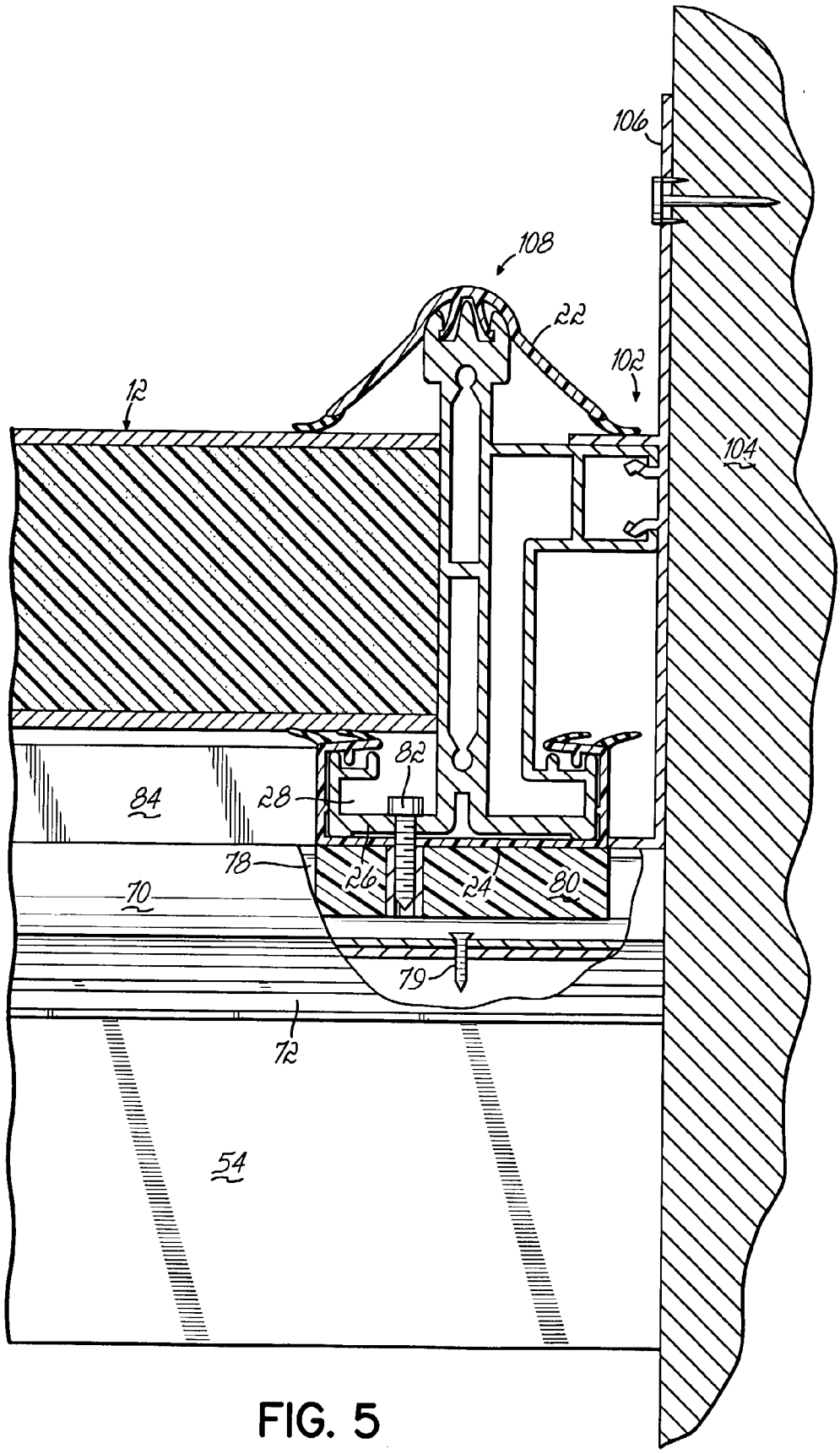
FIG. 5 is a cross-sectional view taken at lines 5—5 of FIG. 1.

As shown in FIG. 5, one edge 102 of the roof attaches to the wall structure 104 of the building using a nailing fin structure 106. The end rafter 108 simply snap-fits onto the nailing fin with a channel of the rafter snapping over a prong portion of the nailing fin. The nailing fin as shown is fastened to the wall and siding (not shown) placed over the nailing fin which then acts as flashing. Additional flashing may be used if desired.

A roof system of the present invention can be either assembled on site or more preferably is assembled in the factory. With factory assembly, the roof including the upper member 32 of the eaves beam and everything resting on that structure including the rafters, any ridge beam or hip beam and glazed panels are all assembled.

To install the roof, the base member 30 is placed on the upper surface 31 of the wall 29. As shown, the wall 29 is wood. A plurality of screws 91 are inserted through the base plate 36 into the wall 29. After the base member 30 is fastened onto the wall 29, the assembled roof is lowered onto the walls with the top member 32 placed over the base member 30 so that the bottom edges 86 and 88 of legs 56 and 58 rest on the outer edges of base plate 30. Screws 90 and 92 are then screwed through legs 56 and 58 through walls 42 and 44 fastening the top member 32 in position. Plastic trim can then be used to finish off the inside and outside of the structure.

As shown an upper trim member 94 is placed over barbed member 62 and a lower trim member 96 is inserted into channel 38. Likewise a similar plastic trim structure 98 is attached to the exterior in channel 40. Other exterior trim or a gutter system can be applied if desired.

It is important to note that the base member can be redesigned if necessary to fit over a masonry structure or basically any other wall structure. It can be designed for either a two by four wall or a two by six wall, or other dimensions if desired. It is simply required that the base member and the top member mate and are adapted to be fastened to each other to provide for ease of installation of the product.

In addition to utilizing mating upper and lower eaves beam sections, the present invention particularly the preassembled glazed roof could be attached using lower brackets which would attach to the upper beam section. This would work as opposed to a continuous mating lower section. Other means to attach the upper beam section could also be employed as long as the roof could be constructed as a unitary structure supported at its base by an eaves beam and placed on a wall structure as a preassembled unit.

Further the present invention provides for drainage of any internal condensation that runs down the inside of the rafter system. This would be collected in trough 66 and run through holes 68 into the central area of 69. This would then run down sloped wall 60 and be permitted then to drain to the exterior of the building through drain holes 100. This prevents water from running down the side walls should any leak into the building or condense on the panels.

This has been a description of the present invention along with the preferred mode of practicing the invention.

However, the invention itself should only be defined by the appended claims wherein we claim:

1. An eaves beam comprising at least one base member and an elongated upper member;

said base member having a base plate and a first and second upwardly extended walls from said base plate, said base plate and said walls providing a channel;

wherein a first fastener is positioned in said channel and is extended through said base member into a supporting wall for securing said base member to said supporting wall;

said elongated upper member having a rafter support an inner wall and an opposing outer wall and first and second downwardly extended leg members, wherein said first downwardly extended leg member is generally parallel to said first upwardly extended wall and said second downwardly extended leg member is generally parallel to said second upwardly extended wall, said elongated upper member engages said base member adjacent said upwardly extended walls and said downwardly extended leg members, wherein said elongated upper member includes a lower wall positioned below said rafter support and extending from said inner wall to said outer wall;

wherein a second fastener is extended through one of said downwardly extended leg members and one of said upwardly extended walls fastening said elongated upper member to said base member.

2. The eaves beam claimed in claim 1 wherein said lower wall is sloped towards a drainage hole and said elongated upper member further includes an upper wall having a water collecting trough and a hole adapted to admit water to said sloped lower wall.

3. An eaves beam comprising at least one base member and an elongated upper member;

said base member having a base plate and a first and second upwardly extended walls from said base plate, said base plate and said walls providing a channel, wherein said base member further includes a trim receiving channel;

wherein a first fastener is positioned in said channel and is extended through said base member into a supporting wall for securing said base member to said supporting wall;

said elongated upper member having a rafter support and first and second downwardly extended leg members, wherein said first downwardly extended leg member is generally parallel to said first upwardly extended wall and said second downwardly extended leg member is generally parallel to said second upwardly extended wall, said elongated upper member engages said base member adjacent said upwardly extended walls and said downwardly extended leg members;

wherein a second fastener is extended through one of said downwardly extended leg members and one of said upwardly extended walls fastening said elongated upper member to said base member.

4. A pre-assembled roof structure comprising:

a first eaves beam member;

an adjustable rafter support attached to said first eave beam member;

a plurality of rafters extending from said adjustable rafter support to an upper rafter support;

a plurality of panels glazed to said rafters, wherein said first eaves beam member, said adjustable rafter support, said rafters, said panels, and said upper rafter support secured together to form a unitary roof structure;

a fastener means for attaching said unitary roof structure to a supporting wall;

wherein said fastener means comprises a second eaves beam member which is attachable to a header of a wall and wherein said first eaves beam member is attachable to said second eaves beam member after said second eaves beam member is attached to said wall.

5. The pre-assembled roof structure claimed in claim 4 wherein said upper rafter support is a ridge beam.

6. The pre-assembled roof structure claimed in claim 4 further comprising:

an edge rafter, wherein at least one of said panels is glazed to said edge rafter; and a nailing fin having a connecting member fixed to and supporting said edge rafter along its entire length and adapted to attach said edge rafter to a wall structure of a building.

7. The pre-assembled roof structure claimed in claim 6 wherein said edge rafter has a channel;

said channel being connected to said connecting member of said nailing fin.

8. The pre-assembled roof structure claimed in claim 7 wherein said connecting member has prongs.

9. The pre-assembled roof structure claimed in claim 4 further comprising:

a sealing cap attached over a given rafter of said rafters at an end of said unitary roof structure;

a nailing fin attached to said unitary roof structure, said nailing fin having an edge; and wherein said sealing cap forms a seal with said edge of said nailing fin.

10. The pre-assembled roof structure claimed in claim 9 wherein said edge of said nailing fin is sandwiched between said sealing cap and said given rafter.

11. A pre-assembled roof structure comprising:

a first eaves beam member;

an adjustable rafter support attached to said first eave beam member;

a plurality of rafters extending from said adjustable rafter support to an upper rafter support;

a plurality of panels glazed to said rafters, wherein said first eaves beam member, said adjustable rafter support, said rafters, said panels, and said upper rafter support secured together to form a unitary roof structure;

a fastener means for attaching said unitary roof structure to a supporting wall;

a nailing fin having a connecting member fixed to and supporting a given rafter of said rafters at an end of said unitary roof structure; and said nailing fin adapted to support said given rafter along its entire length and attach said given rafter to a wall structure of a building.

12. The pre-assembled roof structure claimed in claim 11 wherein said connecting member comprises an elongated member being fixed into a channel with said first eaves beam member.

13. A pre-assembled roof structure comprising:

a first eaves beam member;

an adjustable rafter support attached to said first eave beam member;

a plurality of rafters extending from said adjustable rafter support to an upper rafter support;

a plurality of panels glazed to said rafters, wherein said first eaves beam member, said adjustable rafter support, said rafters, said panels, and said upper rafter support secured together to form a unitary roof structure;

a fastener means for attaching said unitary roof structure to a supporting wall;

an edge rafter; and a nailing fin having a connecting member fixed to and supporting said edge rafter along its entire length and adapted to attach said edge rafter to a wall structure of a building.

14. The pre-assembled roof structure claimed in claim 13 wherein said edge rafter has a channel;

said channel adapted to connect to said connecting member of said nailing fin.

15. The pre-assembled roof structure claimed in claim 14 wherein said connecting member has prongs.

16. A pre-assembled roof structure comprising:

a first eaves beam member;

an adjustable rafter support attached to said first eave beam member;

a plurality of rafters extending from said adjustable rafter support to an upper rafter support;

a plurality of panels glazed to said rafters, wherein said first eaves beam member, said adjustable rafter support, said rafters, said panels, and said upper rafter support coupled together to form a unitary roof structure;

a fastener means for attaching said unitary roof structure to a supporting wall;

a sealing cap attached over a given rafter of said rafters positioned at an end of the unitary roof structure;

a nailing fin attached to said unitary roof structure, said nailing fin having an edge; and wherein said sealing cap forms a seal with said edge of said nailing fin.

17. The pre-assembled roof structure claimed in claim 16 wherein said edge of said nailing fin is sandwiched between said sealing cap and said given rafter.

18. A pre-assembled roof structure comprising:

a first eaves beam member;

a plurality of rafters extending from said first eaves beam member to an upper rafter support;

a plurality of panels glazed to said rafters, wherein said first eaves beam member, said rafters, said panels, and said upper rafter support coupled together to form a unitary roof structure;

a fastener means for attaching said unitary roof structure to a wall, wherein said fastener means comprises a second eaves beam member which is attachable to a header of a supporting wall and wherein said first eaves beam member is attachable to said second eaves beam member after said second eaves beam member is attached to said wall;

a nailing fin having a connecting member fixed to and supporting a given rafter of said rafters at an end of said unitary roof structure; and said nailing fin supporting said given rafter along its entire length and adapted to attached said given rafter to a wall structure of a building.

19. The pre-assembled roof structure claimed in claim 18 wherein said connecting member comprises an elongated member fitted into a channel with said first eaves beam member.

20. A roof structure comprising:

an elongated lower eaves beam member having a base plate and a pair of generally parallel upwardly extended legs, said base plate and said upwardly extended legs providing a channel;

a first fastener positioned in said channel and extended through said elongated lower eaves beam member and into a header of a building wall for securing said elongated lower eaves beam member to said building wall;

a pre-assembled upper unitary roof assembly comprising an elongated upper eaves beam member having a pair of generally parallel downwardly extended legs, a plurality of rafters attached to, supported by, and extending from said elongated upper eaves beam member to an upper rafter support member, a plurality of panels glazed to said rafters, an edge rafter wherein at least one of said panels is glazed to said edge rafter, and a nailing fin having an elongated connecting member fixed to and supporting said edge rafter along its entire length and adapted to attach said edge rafter to a wall structure of a building;

wherein said parallel upwardly extended legs engage said parallel downwardly extended legs wherein a second fastener is extended through one of said downwardly extended legs and one of said upwardly extended legs fastening said pre-assembled upper unitary roof assembly to said elongated lower eaves beam member;

wherein said pre-assembled upper unitary roof assembly is attached to said elongated lower eaves beam after said elongated lower eaves beam is attached to said header of said building wall.

* * * * *